United States Patent [19]

Bonhomme

[11] Patent Number: 4,767,360

[45] Date of Patent: Aug. 30, 1988

[54] ELECTRIC CONTACT SOCKETS

[76] Inventor: Francois R. Bonhomme, 6 Parc de Béarn, 92 210 Saint Cloud, France

[21] Appl. No.: 56,820

[22] PCT Filed: Sep. 24, 1986

[86] PCT No.: PCT/FR86/00324

§ 371 Date: May 11, 1987

§ 102(e) Date: May 11, 1987

[87] PCT Pub. No.: WO87/02196

PCT Pub. Date: Apr. 9, 1987

[30] Foreign Application Priority Data

Sep. 25, 1985 [FR] France ..... 85 14174

[51] Int. Cl.[4] ..... H01R 13/44

[52] U.S. Cl. ..... 439/593; 439/723; 439/787; 439/851

[58] Field of Search ..... 439/593, 723, 787, 817, 439/824, 835, 851, 883, 592, 603

[56] References Cited

U.S. PATENT DOCUMENTS

| | | | |
|---|---|---|---|
| 2,318,648 | 5/1943 | Penfold | 439/723 |
| 2,318,651 | 5/1943 | Penfold | 439/723 |
| 2,396,725 | 3/1946 | Thomas, Jr. | 439/590 |
| 3,275,967 | 9/1966 | Hamm | 439/593 |
| 3,368,181 | 2/1968 | Gimpel | 439/851 |
| 3,716,821 | 2/1973 | Appleton | 439/787 |
| 4,545,638 | 10/1985 | Neidich | 439/723 |

FOREIGN PATENT DOCUMENTS

| | | |
|---|---|---|
| 992456 | 12/1951 | France . |
| 993266 | 5/1965 | United Kingdom . |

*Primary Examiner*—Gil Weidenfeld
*Assistant Examiner*—Paula A. Austin
*Attorney, Agent, or Firm*—Larson and Taylor

[57] ABSTRACT

An electric contact socket (1), open at its longitudinal ends so as to be capable of receiving two aligned contact plugs (2, 3), comprises a metallic sleeve (4) provided with at least one longitudinal slot (5) which extends from one longitudinal end to the other of this sleeve and transverse slots (7) extending from the or each longitudinal slot at least approximately halfway along the length of the sleeve (4). The sleeve is encompassed by a hollow body (6) of insulating elastomer.

8 Claims, 3 Drawing Sheets

ELECTRIC CONTACT SOCKETS

The invention relates to electric contact sockets of the type which are open at their two longitudinal ends so as to be capable of receiving two aligned contact plugs respectively inserted through these two ends to in this way electrically connect conductors attached to these two plugs, and which are essentially formed by a metallic sleeve provided with at least one longitudinal slot.

A contact socket of this type is described in French patent 967,631. In this case, the sleeve is constituted by a single metallic tubular part provided with longitudinal slots which extend alternately from one longitudinal end of this part and from the other end and which stop short of the opposite end. An elastic element constituted by a metallic wire is coiled around the sleeve, the annular profile (seen from the end) of the spring thus formed being generally polygonal so as to limit to points located on generatrices the contact of this spring with the outer surface of the tubular part.

A drawback of this known contact socket is that the insertion of one plug through one of the ends of its tubular part causes such deformation of this part at the other of its ends that the insertion of the other plug therein is rendered difficult. Another drawback is that, when the two plugs do not have exactly the same diameter, the contact between each plug and the tubular part can only occur at points spaced apart on a transverse line and not on a notable part of the surface of this plug. Yet another drawback of this socket is that special measures must be taken to electrically insulate the outer surface of the tubular part and the spring surrounding it to avoid any risk of a short circuit.

U.S. Pat. No. 2,318,648 describes an electric contact socket whose sleeve has a longitudinal slot extending throughout the length of the sleeve and a median transverse slot defining semi-sleeves interconnected by a continuous strip of material, the sleeve being inserted with clearance in a housing of insulating material.

This socket requires high manufacturing precision and does not permit the use of plugs whose diameters have a wide tolerance. A fortiori plugs having different nominal diameters cannot be inserted therein.

An object of the invention is to overcome these drawbacks of known sockets.

For this purpose, the electric contact socket of the type defined above is essentially characterised in accordance with the invention in that the or each longitudinal slot of the sleeve extends from one longitudinal end to the other of this sleeve; in that the latter is provided moreover with transverse slots extending the or each longitudinal slot at least approximately midway along the length of the sleeve and so dimensioned that they leave in the material of the sleeve at least one continuous strip extending from one to the other of the longitudinal ends of the sleeve and in that the elastic element encompassing the sleeve is made from a hollow body of insulating elastomer.

Owing to the presence of the transverse slot or slots, the deformations produced at one of the longitudinal ends of the sleeve by the insertion of a plug are practically not transmitted to the other longitudinal end and therefore are not liable to compromise the insertion of another plug in this other end. Further, owing to this independence of the deformations, the socket according to the invention accepts large differences in diameter between the opposed plugs. Moreover, as the elastic element which encompasses the sleeve is in itself insulating, no additional measure for insulating is to be taken to avoid short circuits.

Further characteristics and advantages of the invention will be explained hereinafter with the aid of the following additional description with reference to the accompanying drawings.

FIG. 1 of these drawings represents separately a socket arranged in accordance with a first embodiment of the invention and shown in a diagrammatic axial section and two plugs intended to cooperate with this socket.

Figure 12:
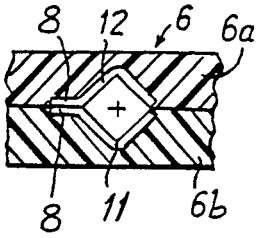
FIG. 12 shows, in cross-section, the complete socket whose sleeve is represented in FIG. 9.
Figure 13:
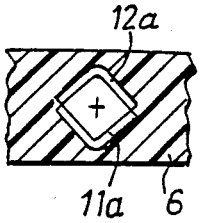
Figure 14:
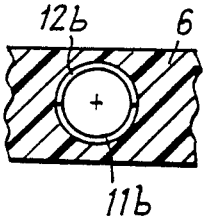
Figure 15:
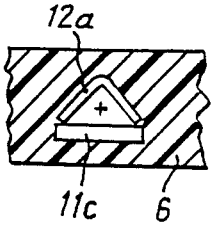

FIGS. 13 to 15 each represent a modification of the socket of FIG. 12.

Figure 1:
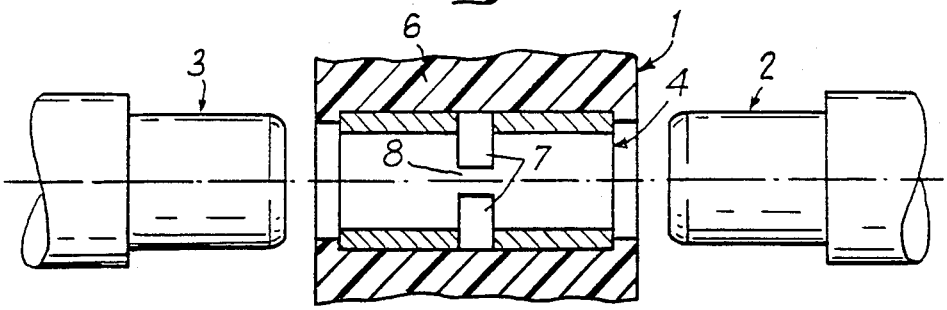

In FIG. 1 there is shown an electric contact socket 1 which is open at its two longitudinal ends so as to be capable of receiving two aligned contact plugs 2 and 3 respectively inserted in these two ends and thus electrically connecting conductors (not shown) attached to these two plugs 2, 3 and which is essentially constituted by a metallic sleeve 4 provided with at least one longitudinal 5 (see FIG. 5) and encompassed by an elastic element 6.

Figure 5:
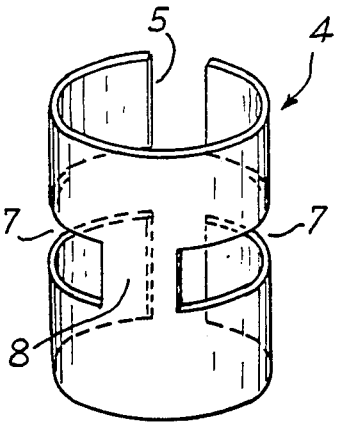
FIGS. 5 and 6 represent in perspective two possible embodiments for the sleeve in a single piece which is part of the socket of FIGS. 1 to 3.

According to the invention, the longitudinal slot 5, which is the sole longitudinal slot according to the embodiment of FIGS. 1 to 3 and 5, extends from one longitudinal end to the other of the sleeve 4, as is clear from FIG. 5. This sleeve 4 is further provided with two transverse slots 7 each of which extends from the longitudinal slot 5, midway along the length of the sleeve 4, and which are so dimensioned that they leave, in the material of the sleeve 4, a continuous strip 8 which extends from one to the other of the longitudinal ends of the sleeve 4. Lastly, the element 6 is made from a hollow body of insulating elastomer (elastic plastics material or natural or synthetic rubber).

Figure 6:
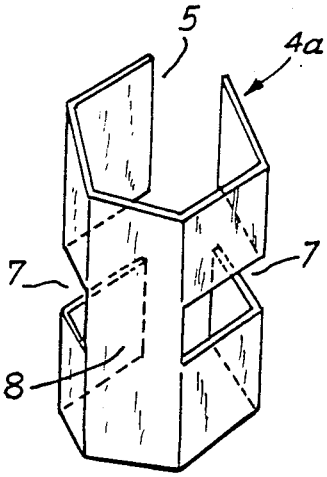

In the embodiment of FIGS. 1 to 3 and 5, the sleeve 4 may have a cylindrical shape of an open contour. According to the modification of FIG. 6 where the sleeve is designated by **4*a*, the latter may have an open polygonal contour, for example a pentagonal contour, in which case the strip 8** may correspond to the median side of the polygon forming this contour.

Figure 7:
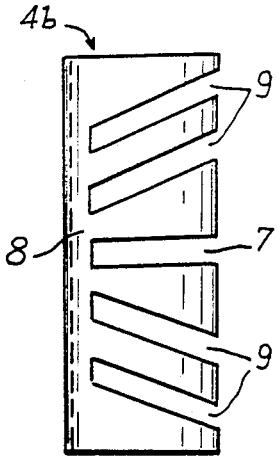
FIGS. 7 and 8 represent respectively in elevation and in a view from one end, a possible third embodiment of this sleeve in a single piece.
Figure 8:
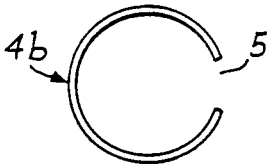
Figure 11:
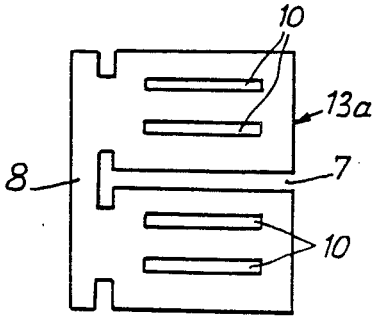
FIG. 11 represents a modification of FIG. 10.

In FIGS. 1 to 3, 5 and 6, it has been assumed, on one hand, that the transverse slots 7 were perpendicular to the generatrices of the sleeve 4 or **4*a*. However, it is not excluded that these slots be more or less inclined relative to a plane perpendicular to these generatrices. It has been assumed, on the other hand, that the sleeve 4 or 4***a* had only two transverse slots 7 located midway along the length of the sleeve 4. Nonetheless, as shown in FIGS. 7 and 8 where the sleeve has been designated by 4*b*, the transverse slots 7 could be accompanied by additional transverse slots 9 which are either parallel to the slots 7 or (as represented) more or less inclined relative to the latter and adapted to increase the number of points of contact. These additional transverse slots 9 may extend either from the longitudinal slot 5, as shown in FIGS. 7 and 8, or not reach this longitudinal slot as for example additional transverse slots 10 which will be described hereinafter with reference to FIG. 11, provided they leave in all cases the continuous strip 8.

Lastly, the sleeve 4 is made from a thin metal or alloy blank suitably formed, this metal or alloy being in itself elastic or non-elastic. The sleeve 4 is either maintained in a cavity previously provided in the insulating body 6, which is then advantageously made in two parts such as 6*a*, 6*b* fixed together for example by adhesion or ultrasonic welding (see FIG. 12), or moulded in this insulating body 6.

There is obtained in this way a socket 1 which operates in the following manner.

As explained above with the aid of FIG. 1, it concerns the interconnection of conductors (not shown) respectively attached to aligned plugs 2 and 3 whose diameters exceed the transverse inner dimensions of the sleeve 4 at rest. First of all, the plug 2 is inserted in the socket 1, which deforms either completely (FIG. 2) the sole part of the sleeve 4 located adjacent to this plug 2 and limited by the transverse slots 7, or progressively the parts of the sleeve 4 which are successively limited by the transverse slots 9 and 7 (FIGS. 7 and 8). In both cases, the deformation of the sleeve 4, which produces an elastic deformation of the neighbouring zones of the body 6, cannot or can hardly be propagated toward the opposite part of the sleeve 4. It is therefore possible to insert the plug 3 without difficulty, as shown in FIG. 3, which also produces an elastic deformation of the neighbouring zone of the body 6, and this ensures in this way a good surface contact under pressure between the plugs 2 and 3 and the sleeve 4, even if the active parts of the plugs 2 and 3 have diameters which are slightly different from each other.

Figure 3:
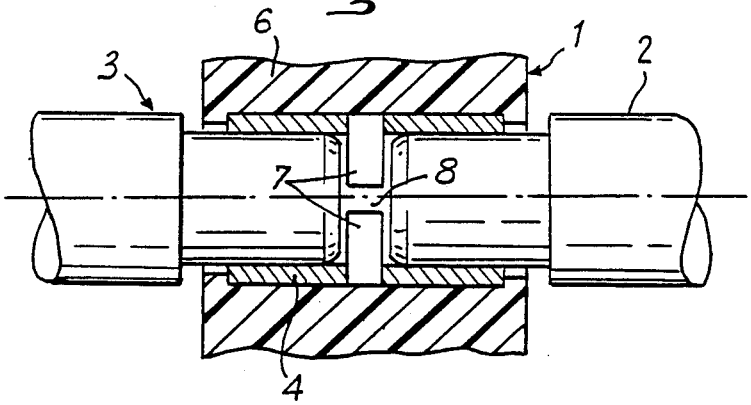
Figure 4:
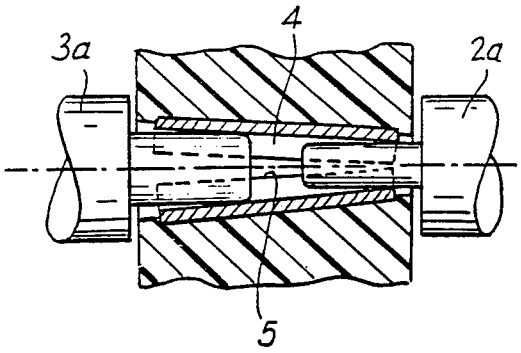
FIG. 4 illustrates, in a view similar to that of FIG. 3, the deformation of a socket which is not in conformity with the present invention.

In order to appreciate this latter advantage of the invention more clearly, there is shown in FIG. 4 what would happen if a sleeve such as 4, 4*a* or 4*b* provided with a longitudinal slot 5 but devoid of transverse slots 7 and/or 9, were used with plugs such as 2*a* and 3*a* having active parts whose diameters are different (these differences have been exaggerated in FIG. 4 for reasons of clarity). It is clear that the deformation due to the insertion of the plugs is propagated from one longitudinal end of the sleeve 4 to the other, which limits the zones of contact to lines instead of surfaces as in FIG. 3.

Figure 2:
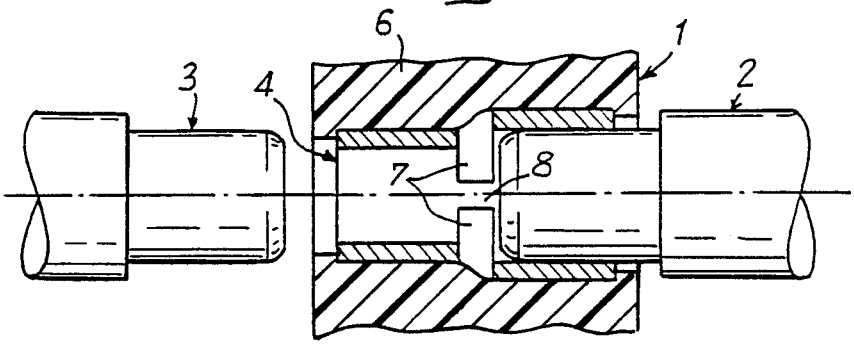
FIGS. 2 and 3 represent the socket of FIG. 1 after the insertion of the right plug and the insertion of two plugs respectively.

If one now starts in the plugged-in position of FIG. 3 and removes the plug 3 or 2 and then the plug 2 or 3, the elasticity of the body 6, which may possibly be assisted by that of the sleeve 4, causes these elements 4 and 6 to successively return to the positions of FIGS. 2 and 1.

Figure 9:
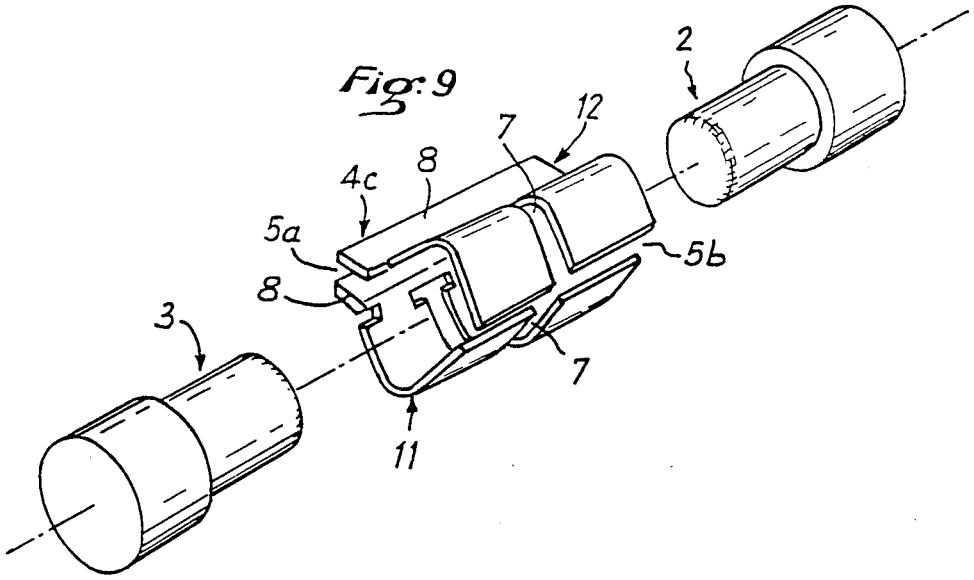
FIG. 9 represents in perspective a sleeve in two parts which is part of a socket arranged in accordance with a second embodiment of the invention, and two plugs intended to cooperate with this socket.

According to the embodiment of FIG. 9, the single longitudinal slot 5 of the preceding embodiment is replaced by two slots 5*a* and 5*b* which consequently divide the sleeve, here designated by 4*c*, into two parts 11 and 12 each of which is provided with a transverse slot 7. Each transverse slot 7 extends from one of the longitudinal slots 5*a*, 5*b* midway along the length of the part 11 or 12, and is so dimensioned as to leave, in the material of this part, a continuous strip 8 which extends from one to the other of the longitudinal ends of the sleeve 4*c*.

According to the embodiment of FIGS. 9 and 12, each part 11, 12 has a profile approximately as a right angle so that, when the two parts, 11, 12 are placed against each other (see FIG. 12), they together delimit a passage whose contour is approximately square in which may be inscribed, at rest, a circle whose diameter is less than that of the cross-section of the plugs 2 and 3. In order to facilitate the centering of the two parts 11, 12 with respect to each other, each of them may include a wing bent at 45° relative to the neighbouring side and coinciding more or less with the continuous strip 8 so that these wings are applied against each other at rest, as shown in FIG. 12.

Figure 10:
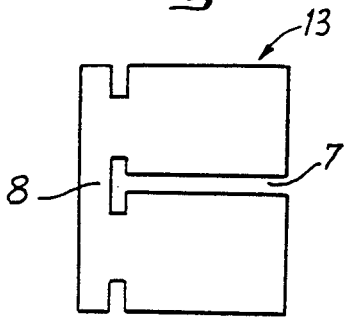
FIG. 10 represents a sheet metal blank for producing each of the two parts of the sleeve of FIG. 9.

FIG. 10 shows a planar blank 13 cut out or blanked from a metal sheet permitting the production of the parts 11 and 12 indifferently by a suitable deforming process. This blank is provided with its transverse slot 7 and could moreover include additional transverse slots open on the same side as the slot 7 (such as those designated by 9 in FIG. 7), or, as shown in FIG. 11, where the blank has been designated by 13*a*, additional closed transverse slots 10 which are parallel to the slot 7 (as shown) or inclined relative to the latter.

The modification of FIG. 13 differs from the embodiment of FIGS. 9 and 12 only in the absence of the wing bent at 45 ° on the parts 11*a* and 12*a*. The modification of FIG. 14 differs from that of FIG. 13 by the circular (and not square) assembly profile of the two parts 11*b* and 12*b*. Lastly, the modification of FIG. 15 differs from that of FIG. 13 by the replacement of one 11*a* of the parts 11*a*, 12*a* of dihedral shape by a planar part 11*c*, the assembly profile of the parts 11*c* and 12*a* then being triangular.

The operation of the embodiment of FIGS. 9 and 12 and of their various modifications is the same as that of the embodiment of FIGS. 1 to 3 and 5, apart from the fact that the elastic deformation of the socket occurs exclusively in the hollow body 6 or 6*a*, 6*b*.

I claim:

1. An electric contact socket which is open at its two longitudinal ends so as to be capable of receiving two aligned contact plugs respectively inserted through these two ends, and thus electrically connecting conductors attached to these two plugs and which is essentially constituted by a metallic sleeve provided with at least one longitudinal slot and encompassed by an elastic element, characterized in that the or each longitudinal slot of the sleeve extends from one longitudinal end to the other of said sleeve; in that the sleeve is further provided with transverse slots extending from the or each longitudinal slot at least approximately midway along the length of the sleeve and so dimensioned that they leave, in the material of the sleeve, at least one continuous strip extending from one to the other of the longitudinal ends of the sleeve and in that the elastic element encompassing the sleeve is made from a hollow body of insulating elastomer, the inner surface of said hollow body of insulating elastomer being in contact with substantially the entire outer surface of said sleeve whereby, upon insertion of a plug into an open end of said sleeve, deformation of said sleeve caused by insertion of said plug into said open end of said sleeve causes an elastic deformation of the neighboring area of said hollow elastomer body and whereby, on removal of said plug from said open end of said sleeve, elasticity of the hollow elastomer body causes the deformed portion of the sleeve and the neighboring area of the hollow elastomer body to return to their undeformed condition.

2. A socket according to claim 1, characterised in that it is provided with additional transverse slots.

3. A socket according to claim 1, characterised in that the sleeve has, at rest, a circular profile.

4. A socket according to claim 1, characterised in that the sleeve has, at rest, a polygonal profile.

5. A socket according to claim 1, characterised in that the sleeve is made in a single piece so shaped as to have a profile opened by a single longitudinal slot.

6. A socket according to claim 5, characterised in that the sleeve has, at rest, the shape of a pentagon and the continuous strip corresponds to the median side of the pentagon.

7. A socket according to claim 1, characterised in the sleeve is made in two parts alongside each other and separated by two longitudinal slots.

8. A socket according to claim 7, characterised in that the sleeve is constituted by the assembly of a part of dihedral shape and a planar part.

* * * * *